US009585485B2

(12) United States Patent
Murray et al.

(10) Patent No.: US 9,585,485 B2
(45) Date of Patent: Mar. 7, 2017

(54) SEATING DEVICE HAVING A TILT MECHANISM

(71) Applicant: Knoll, Inc., East Greenville, PA (US)

(72) Inventors: Seth Murray, San Francisco, CA (US); Bret Recor, San Francisco, CA (US); Adam Deskevich, Pennsburg, PA (US); Michael Harper, Bethlehem, PA (US); Robert A. Melhuish, East Greenville, PA (US); Hendrik R. van Hekken, Allentown, PA (US); Simon Gatrall, San Francisco, CA (US); Pinida Jan Moolsintong, San Francisco, CA (US); Alexander Kwok Yin Ko, San Francisco, CA (US); Steven Howard Janssens, San Francisco, CA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 15/144,942

(22) Filed: May 3, 2016

(65) Prior Publication Data

US 2016/0331144 A1 Nov. 17, 2016

Related U.S. Application Data

(60) Provisional application No. 62/162,163, filed on May 15, 2015.

(51) Int. Cl.
*A47C 7/56* (2006.01)
*A47C 7/00* (2006.01)

(52) U.S. Cl.
CPC ..... *A47C 7/566* (2013.01); *A47C 7/004* (2013.01)

(58) Field of Classification Search
CPC ..... A47C 3/02; A47C 7/566; A47C 7/004; A47C 3/026; A47C 7/008; A47C 9/00
(Continued)

(56) References Cited

U.S. PATENT DOCUMENTS 2,038,806 A * 4/1936 Sellar ..... A47C 9/025 248/161
2,613,389 A * 10/1952 Cramer ..... B60B 33/06 16/18 CG
(Continued)

FOREIGN PATENT DOCUMENTS

DE 29603988 U1 6/1996
DE 102006047704 A1 4/2008
(Continued)

OTHER PUBLICATIONS

International Search Report of the International Searching Authority for PCT/US2016/030666 dated Jul. 20, 2016.
(Continued)

*Primary Examiner* — Milton Nelson, Jr.
(74) *Attorney, Agent, or Firm* — Buchanan Ingersoll & Rooney PC

(57) ABSTRACT

A seating device can include a seat and a base connected to the seat to support the seat. A tilt mechanism can be connected to at least one of the base and the seat. The tilt mechanism can include at least one of (a) at least one seat connecting member connecting the seat to an upper portion of the base, (b) a plurality of resilient fingers that are attached to the base to engage a floor and flex in response to a user providing a force while sitting or leaning on the seat, and (c) an elastomeric floor engagement member that is attached to the base and has a bottom peripheral portion that contacts a floor and is flexible in response to a user providing the force. In some embodiments, the tilt mechanism may include all of elements (a)-(c).

19 Claims, 7 Drawing Sheets

(58) Field of Classification Search
USPC ..... 297/271.5, 313, 461, 4; 16/32, 33; 248/188.9, 188.8
See application file for complete search history.

(56) References Cited

U.S. PATENT DOCUMENTS

| | | | | |
|---|---|---|---|---|
| 3,188,141 | A * | 6/1965 | Wright | A47C 16/025 297/423.42 |
| 3,312,437 | A | 4/1967 | Barth | |
| 4,130,263 | A | 12/1978 | Roericht | |
| 4,652,050 | A | 3/1987 | Stevens | |
| 4,738,487 | A | 4/1988 | Shalinsky et al. | |
| 5,112,103 | A | 5/1992 | Downer | |
| 5,203,853 | A | 4/1993 | Caruso | |
| 5,590,930 | A * | 1/1997 | Glockl | A47C 3/0257 297/258.1 |
| 5,746,481 | A | 5/1998 | Obermaier | |
| 5,775,774 | A | 7/1998 | Okano | |
| 5,997,087 | A | 12/1999 | Stumpf | |
| 6,817,667 | B2 | 11/2004 | Pennington et al. | |
| 6,824,218 | B1 | 11/2004 | van Hekken | |
| 6,834,916 | B2 | 12/2004 | Volkman et al. | |
| 6,880,886 | B2 | 4/2005 | Bodnar et al. | |
| 6,957,863 | B2 | 10/2005 | Heidmann et al. | |
| 6,997,511 | B2 | 2/2006 | Marchand et al. | |
| 7,198,329 | B1 | 4/2007 | Larson | |
| 7,478,878 | B2 | 1/2009 | Oettinger | |
| 7,798,573 | B2 | 9/2010 | Pennington et al. | |
| 7,887,131 | B2 | 2/2011 | Chadwick et al. | |
| 7,922,248 | B2 | 4/2011 | Aldrich et al. | |
| 3,029,060 | A1 | 10/2011 | Parker et al. | |
| 8,136,876 | B2 | 3/2012 | Bellvis Castillo et al. | |
| 8,157,329 | B2 | 4/2012 | Masoud et al. | |
| 8,167,373 | B2 | 5/2012 | Allison et al. | |
| 3,216,416 | A1 | 7/2012 | Allison et al. | |
| 8,220,872 | B2 | 7/2012 | Hong | |
| D664,779 | S | 8/2012 | Weber et al. | |
| 8,480,171 | B2 | 7/2013 | Chadwick et al. | |
| 8,540,314 | B2 * | 9/2013 | Fernandez | A47C 3/30 297/314 |
| 8,646,841 | B2 | 2/2014 | Molnar | |
| 8,663,514 | B2 | 3/2014 | Deskevich et al. | |
| 8,668,265 | B2 | 3/2014 | Parker et al. | |
| 8,764,117 | B2 | 7/2014 | van Hekken et al. | |
| 8,998,319 | B2 * | 4/2015 | Bahneman | A47C 9/00 297/195.11 |
| 9,060,612 | B2 * | 6/2015 | Lee | A47C 7/14 |
| 2003/0168901 | A1 | 9/2003 | Wilkerson et al. | |
| 2006/0006715 | A1 | 1/2006 | Chadwick et al. | |
| 2008/0290712 | A1 | 11/2008 | Parker et al. | |
| 2014/0263886 | A1 * | 9/2014 | Brown | A47B 91/12 248/188.8 |
| 2016/0088944 | A1 * | 3/2016 | Walser | A47C 3/02 297/313 |

FOREIGN PATENT DOCUMENTS

| | | |
|---|---|---|
| WO | 03024538 | 3/2003 |
| WO | 2005025378 A1 | 3/2005 |

OTHER PUBLICATIONS

Written Opinion of the International Searching Authority for PCT/US2016/030666 dated Jul. 20, 2016.

* cited by examiner

SEATING DEVICE HAVING A TILT MECHANISM

CROSS-REFERENCE TO RELATED APPLICATIONS

This application claims priority to U.S. Provisional Patent Application No. 62/162,163, which was filed on May 15, 2015.

FIELD OF INVENTION

The innovation relates to seating devices such as chairs, stools and sit/stand stools.

BACKGROUND OF THE INVENTION

Chairs often include a base that supports a seat and/or a backrest. Examples of chairs, stools, and other types of seating devices may be appreciated from U.S. Pat. Nos. 8,764,117, 8,663,514, 8,646,841, 8,480,171, 8,220,872, 8,216,416, 8,167,373, 8,157,329, 8,136,876, 8,029,060, 7,887,131, 7,478,878, 7,198,329, 6,997,511, 6,834,916, 6,824,218, 6,817,667, 5,683,139, 5,112,103, 4,738,487, 4,130,263, 3,312,437, and D664,779 and U.S. Pat. App. Pub. Nos. 2003/0168901, 2006/0006715, and 2008/0290712.

Chairs may be configured to include a tilt mechanism for use in controlling tilting of a seat or backrest. Examples of chair tilt mechanism can be seen from U.S. Pat. Nos. 8,668,265, 7,922,248, 7,798,573, 6,957,863, 6,880,886, 5,775,774, 5,203,853, 5,997,087, and 4,652,050. Such tilt mechanisms often require use of one or more springs that are stored internally within a housing that is used to connect a pedestal base so that the base of the chair can support the seat backrest, and armrests of the chair. Such tilt mechanisms can often be expensive to manufacture.

SUMMARY OF THE INVENTION

A seating device, a tilt mechanism for a seating device, and methods of making and using the same are provided. In some embodiments, the seating device can be configured so that the seat is tiltable via a tilt mechanism that includes a floor engagement mechanism attached to the base of the seating device that is configured to deform to provide for tilting of the seat in response to a force provided by the user and at least one seat supporting member that is connected to the seat and is also deformable in response to the force provided by the user. Each seat supporting member and each deformable member of the floor engagement mechanism may be configured to be deformable at the same time about different axes of deformation when responding to one or more forces provided by the user as the user sits in the seat or leans on the seat to provide for tiling of the seat about at least one axis and/or about multiple axes that are defined by elements that deform or flex in response to the one or more forces.

A seating device is provided that can include a seat, a base connected to the seat to support the seat and a tilt mechanism connected to at least one of the base and the seat. The tilt mechanism can include at least one of: (i) at least one seat connecting member connecting the seat to an upper portion of the base, (ii) a plurality of resilient fingers that are attached to the base to engage a floor wherein the fingers are configured to flex in response to a force provided by a user sitting or leaning on the seat, and (iii) an elastomeric floor engagement member that is attached to the base such that an outer peripheral portion of a bottom of the floor engagement member contacts the floor wherein the floor engagement member is configured to flex in response to a force provided by a user sitting or leaning on the seat.

In some embodiments of the seating device, the tilt mechanism can have the at least one seat connecting member that includes a first deformable member and a second deformable member. The first deformable member can extend from a first side of the seat to the upper portion of the base and he second deformable member can extend form a second side of the seat to the upper portion of the base. The second side of the seat can be opposite the first side of the seat (e.g. the first side can be a left side and the second side can be the right side or vice versa). In some embodiments, the first and second deformable members can be portions of a unitary seat connecting member structure that is formed as a one piece structure that is generally triangular in shape. In other embodiments, the first and second deformable members may be separate elements that are attached to the base so that the first and second deformable members define a V-like shape as they extend from the base toward the seat.

The base can have a number of different configurations. In some embodiments, the base can include: a vertically elongated member that is connected to lower ends of the first and second deformable members, first and second inclined members that are connected to a bottom end of the vertically elongated member, and a generally horizontal member having a first end connected to a lower end of the first inclined member and a second end connected to a lower end of the second inclined member. The horizontal member and the first and second inclined members may be attached together to define a triangular shaped structure (e.g. a generally triangular shaped annular base member). The tilting mechanism can also have the plurality of resilient fingers. The fingers can be attached to the generally horizontal member for being attached to the base. In some embodiments, the fingers may be elongated members composed of spring steel or other flexible metal. In other embodiments, the fingers may be composed of an elastomeric material or a polymeric material that is resilient. The tilting mechanism can also have the floor engagement member. The floor engagement member can be connected to the generally horizontal member such that the floor engagement member encloses the fingers. In some embodiments, the floor engagement member can entirely enclose all of the fingers and also encloses a portion of the generally horizontal member.

The base can also include a first inclined arm that extends outwardly away from an upper end of the vertically elongated member adjacent to the first side of the seat and a second inclined arm that extends outwardly away from the upper end of the vertically elongated member adjacent to the second side of the seat. The first inclined arm can be attached to the first deformable member and the second inclined arm can be attached to the second deformable member.

In some embodiments, the seat can be comprised of a core member and a covering attached to the core member. The core member can be attached to the first and second deformable member. The core member can be within the covering or entirely within the covering in some embodiments. The covering can have a number of different configurations. For instance, the covering can have an opening defined in a bottom of the covering and the core member can be attached to the first and second deformable members via an inner seat connecting element that extends between the first and second deformable members. The inner seat connecting element can be connected to the core member in the opening of the covering. The core member can have a plurality of holes.

The holes may be shaped to help define the amount of support the seat may provide to a user. The holes can also help configure the core member to facilitate tilting or bending of the seat in response to forces a user may apply to the seat.

In some embodiments, the first deformable member can have a first inner element within a covering of that member and the second deformable member has a second inner element within a covering. The inner seat connecting element can extend between the first and second inner elements and be integrally connected to the first inner element and the second inner element.

In some embodiments of the seating device, the tilting mechanism may have the plurality of resilient fingers and the base can include a vertically elongated member, first and second inclined members that are connected to a bottom end of the vertically elongated member; and a generally horizontal member having a first end connected to a lower end of the first inclined member and a second end connected to a lower end of the second inclined member. The first and second inclined members may extend downwardly from the bottom end of the vertical elongated member and may also extend away from each other. The fingers can be attached to the generally horizontal member for being attached to the base. Such embodiments may only include the fingers or may also be configured so that the tilting mechanism also has the floor engagement member. The floor engagement member can be connected to the generally horizontal member such that the floor engagement member encloses the fingers. In yet other embodiments, the tilting mechanism can also include one or more deformable members.

Each of the fingers can extend away from the generally horizontal member and can be configured to at least one of flex and deform in response to at least one force provided by a user sitting or leaning on the seat. The floor engagement member can be configured to at least one of flex and deform in response to the at least one force provided by the user. The bottom of the floor engagement member can be configured to be concave in shape such that the outer peripheral portion of the bottom contacts the floor and flexure or deformation of the floor engagement member results in a central portion of the bottom inside of the outer peripheral portion of the bottom contacting the floor. The floor engagement member can be configured to flex in response to the at least one force provided by the user at a same time that the fingers flex. The bottom of the floor engagement member can also have a profile or at least one tread defined thereon. The profile and/or tread(s) can be configured to help facilitate gripping of the floor and improve stability provided by the floor engagement member when the seating device is tilted via user forces (e.g. forward leaning while the user is seated on the seat, etc.).

In some embodiments, the tilting mechanism may only include the floor engagement member. The bottom of the floor engagement member can be concave in shape such that the outer peripheral portion of the bottom contacts the floor and flexure or deformation of the floor engagement member results in a portion of the bottom inside of the outer peripheral portion of the bottom being moved from above the floor into contact with the floor. The floor engagement member can be comprised of an elastomeric material such as a thermoplastic elastomeric material or a thermoset elastomeric material.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of a seating device having a tilt mechanism and embodiments of the tilt mechanism are shown in the accompanying drawings and certain exemplary methods of making and practicing the same are also illustrated therein. It should be appreciated that like reference numbers used in the drawings may identify like components.

DETAILED DESCRIPTION OF EXEMPLARY EMBODIMENTS

Figure 1:
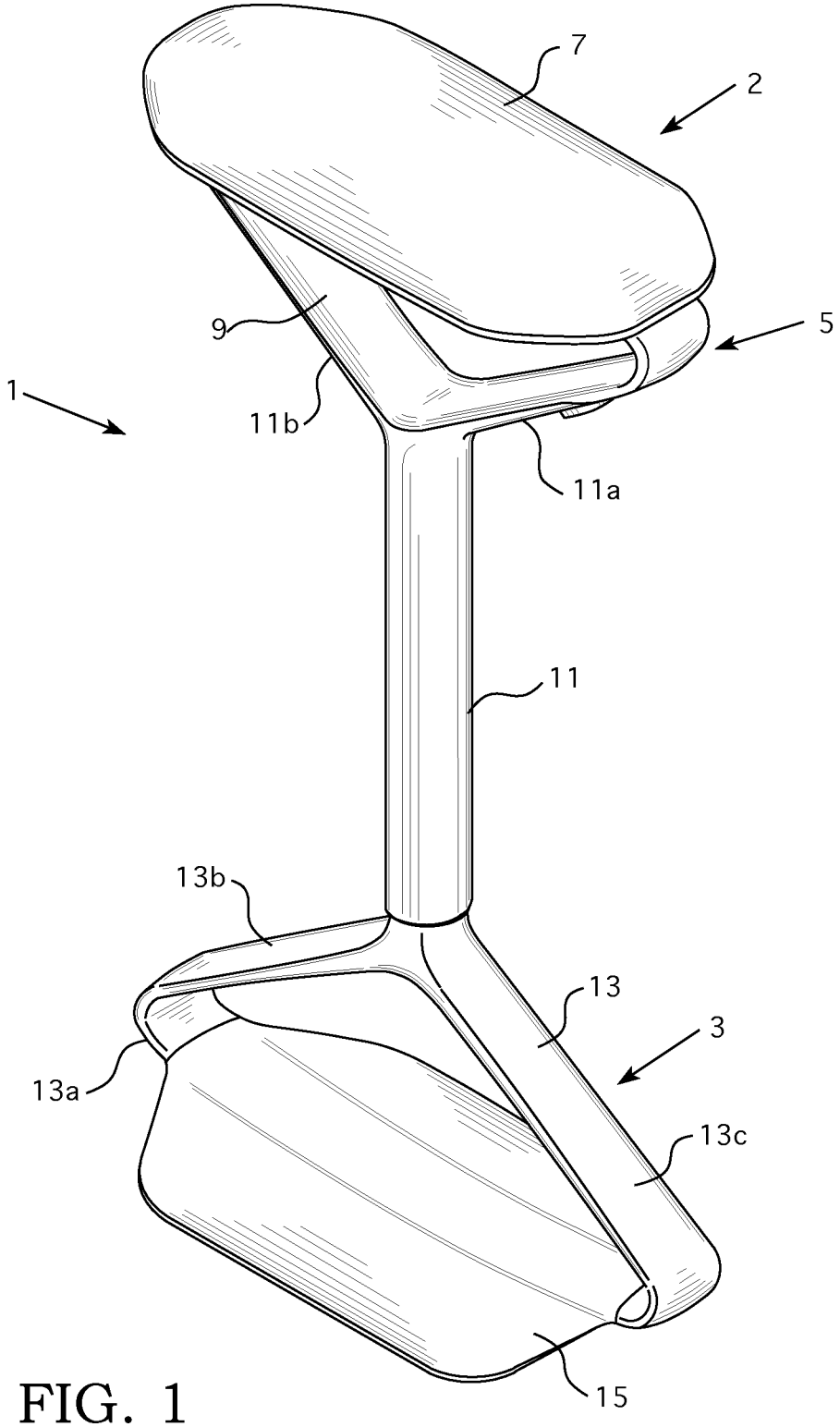
FIG. 1 is a perspective view of a first exemplary embodiment of a seating device.
Figure 2:
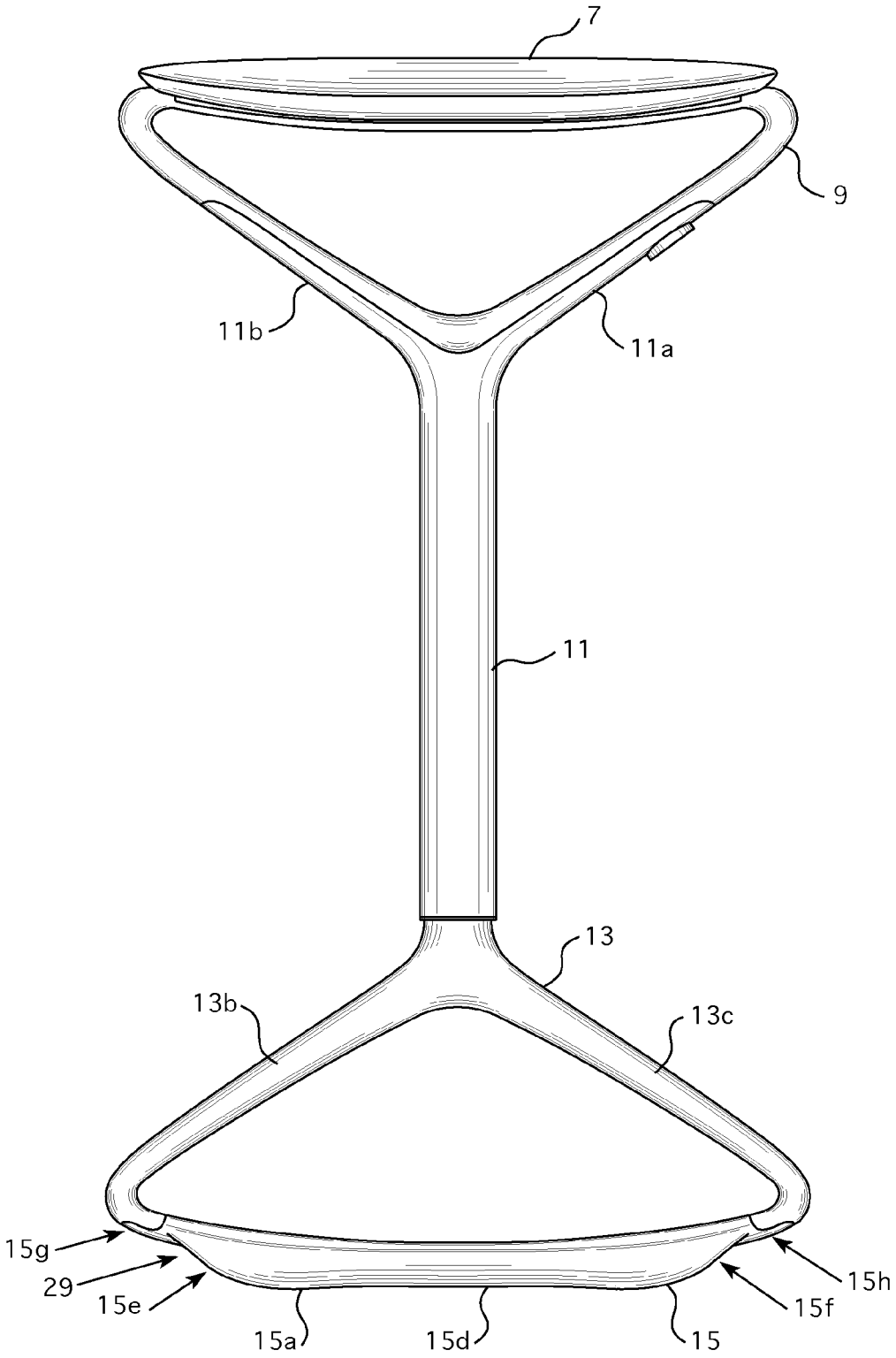
FIG. 2 is a side view of the first exemplary embodiment of the seating device.
Figure 3:
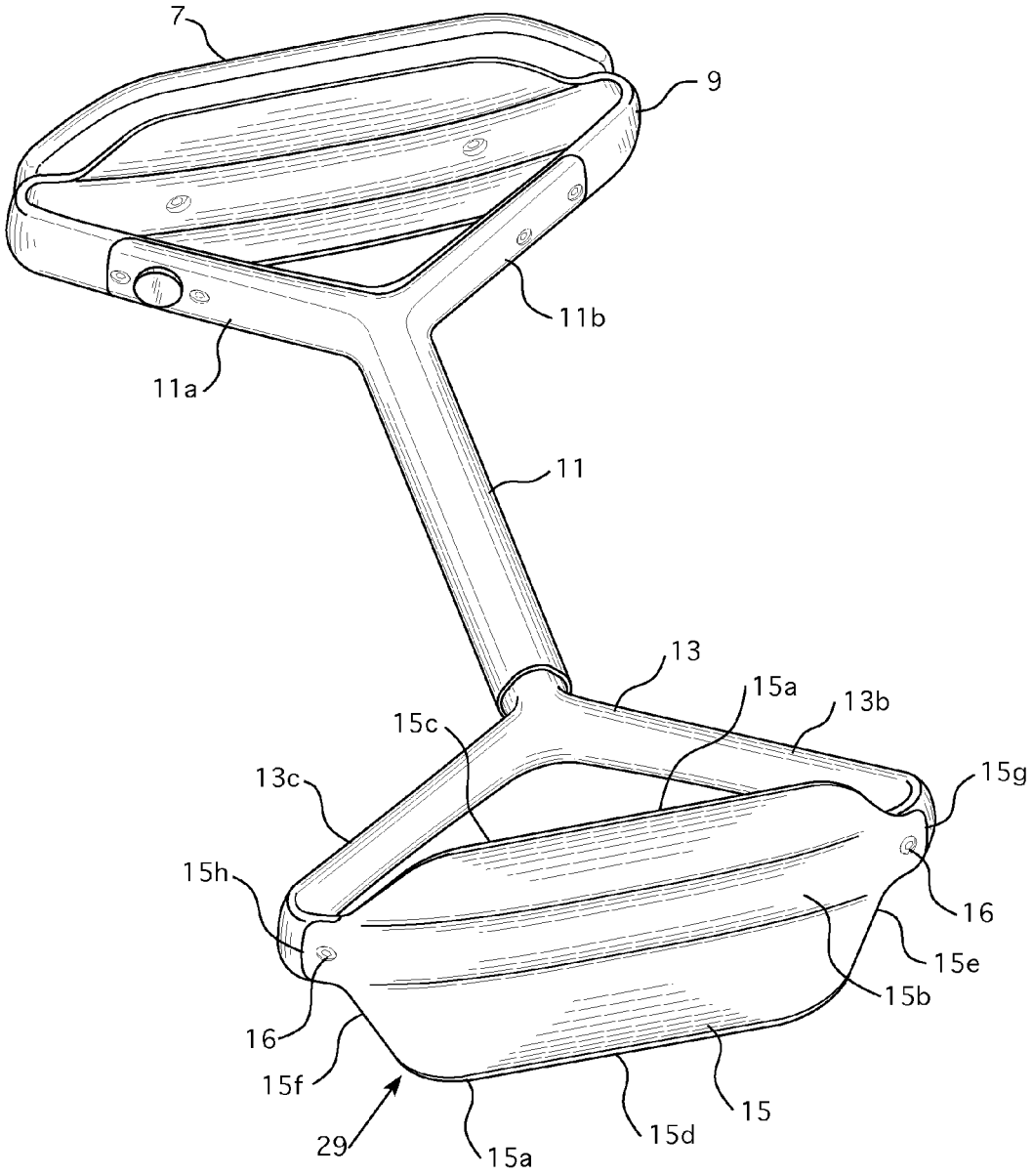
FIG. 3 is a bottom perspective view of the first exemplary embodiment of the seating device.
Figure 4:
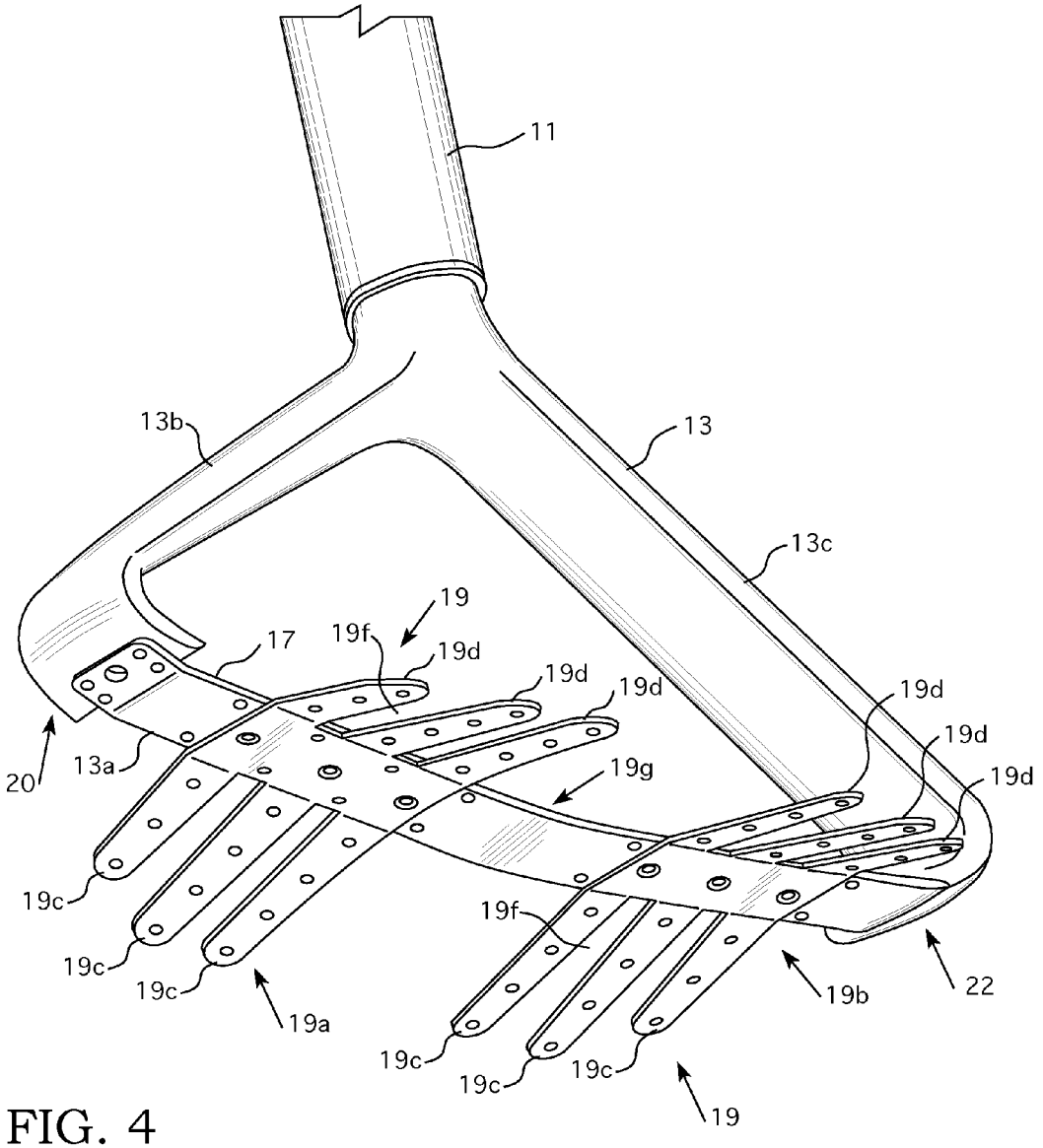
FIG. 4 is a fragmentary view of a bottom portion of the the tilt mechanism of the first exemplary embodiment of the seating device. A floor contacting member 15 that covers resilient fingers 19 is cut away to illustrate the resilient fingers 19 of the bottom portion of the tilt mechanism.
Figure 5:
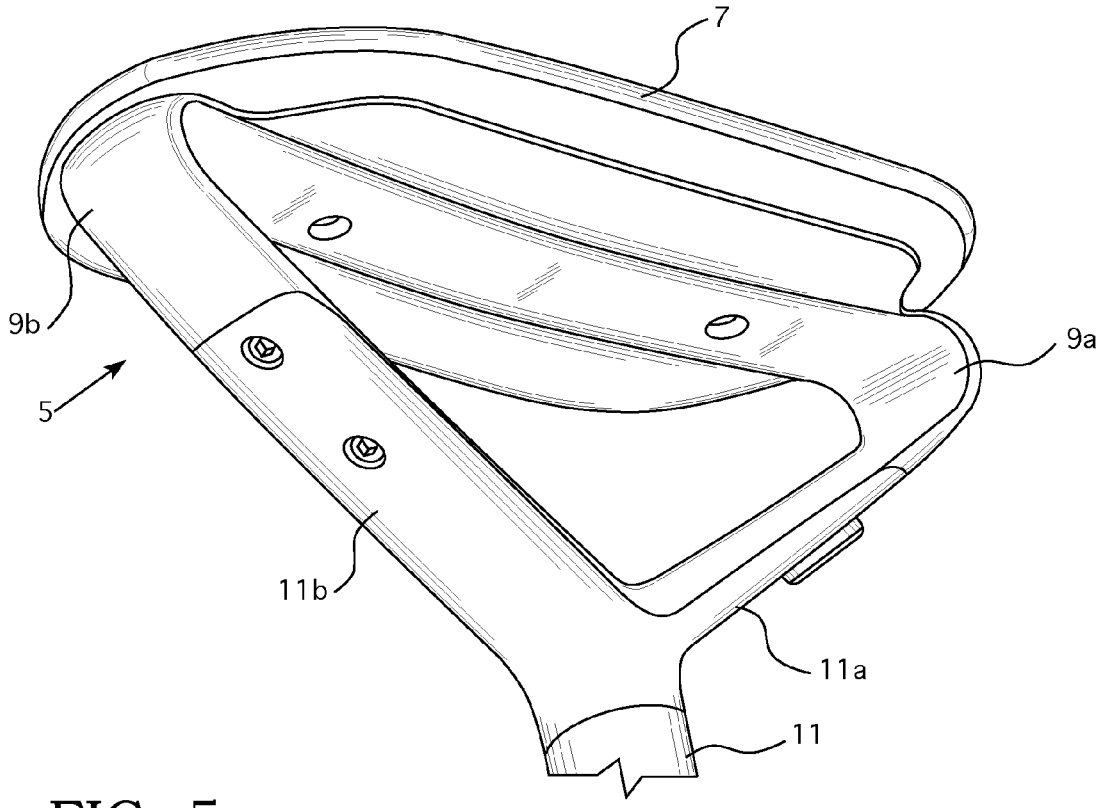
FIG. 5 is an enlarged perspective view of a top portion of the first exemplary embodiment of the seating device.
Figure 6:
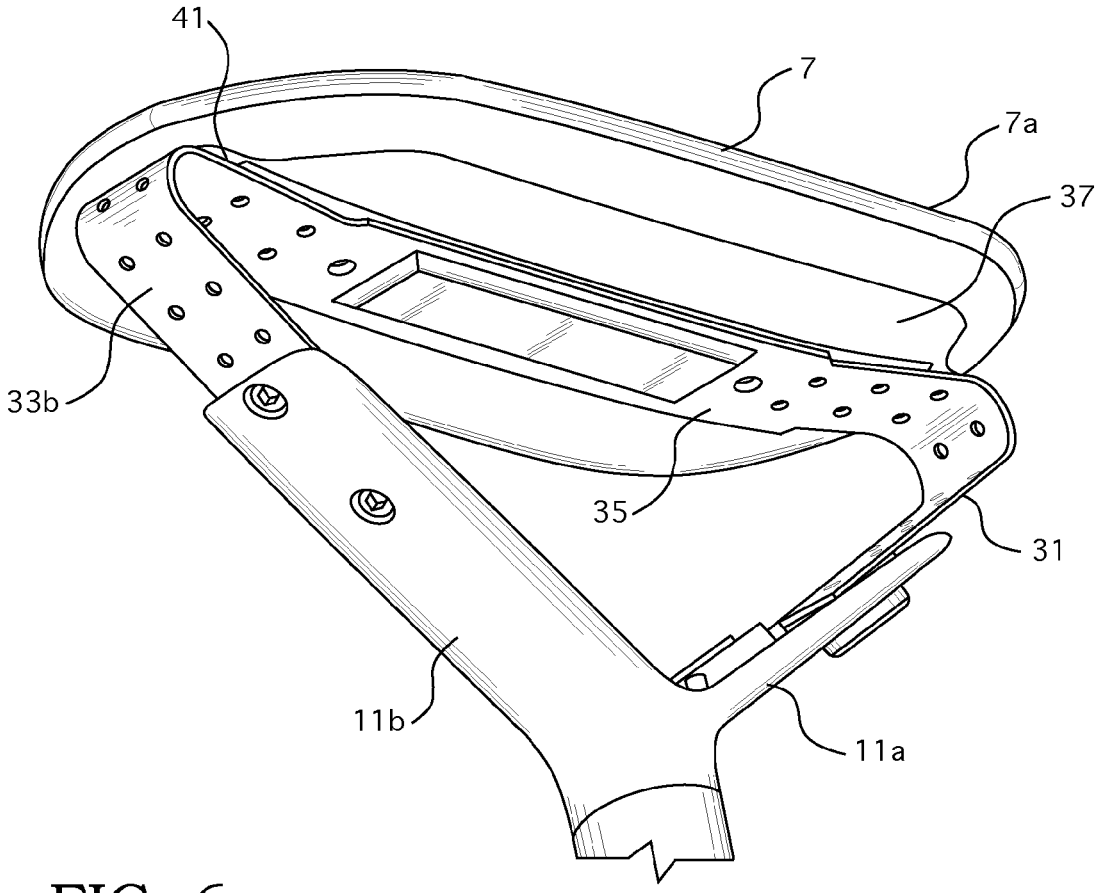
FIG. 6 is a perspective view of the top portion of the first exemplary embodiment of the seating device illustrated in FIG. 5 with an outer covering member of a component of the tilt mechanism is removed to illustrate other inner portions of that component.
Figure 7:
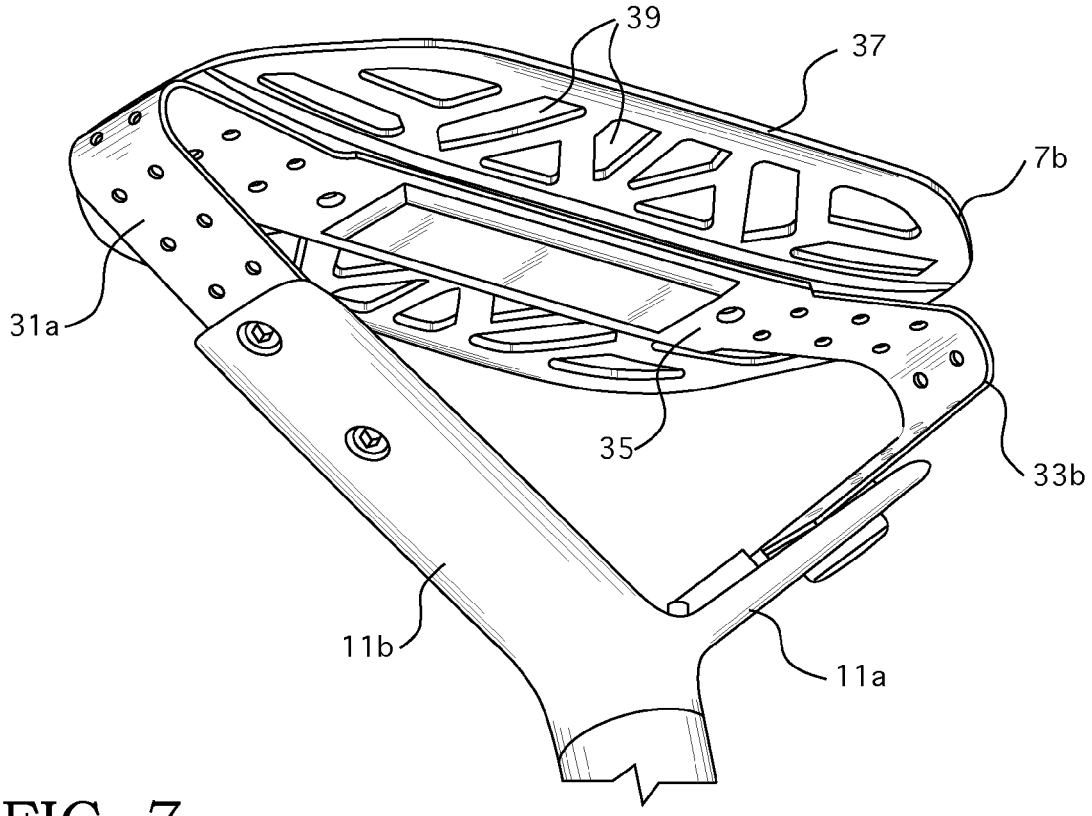
FIG. 7 is a perspective view of the top portion of the first exemplary embodiment of the seating device illustrated in FIG. 6 with a seating cushion element removed to better illustrate another portion of the seat that can provide support to the seating cushion element of the first exemplary embodiment of the seating device.

Referring to FIGS. 1-7, an embodiment of a seating device 1 can be configured as a sit/stand stool. The seating device 1 can include a seat 2 that is supported on a base 3. The seat 2 can be attached to the base via a seat frame 5. In some embodiments, the seat frame 5 can include at least a portion of a tilt mechanism that can be configured to control how the seat 7 of the seating device may be tilted about one or more axes by a user sitting or leaning on the seat 7. The tilt mechanism can include a floor engagement member 15 that is connected to the base 3. In some embodiments, the base 3 can also include a portion of the tilt mechanism that is configured to allow the user to effect tilting of the seat 7 about at least one axis. In some embodiments, the tilting mechanism can be configured so that the tilting is provided via deformation of one or more elastomeric elements such that the tilting is about one or more axes, but that those axes are generally defined by each member being deformed by a force provided by a user instead of being defined by a non-deformable element such as a rigid axle or pivot pin. Other embodiments may be configured to include a combination of non-deformable elements that are configured to provide an axis of rotation for a seating device component in addition to deformable elements.

The floor engagement member 15 can be attached to the bottom of a base member 13. The base member 13 may be an annular triangularly shaped structure having a first generally horizontal member 13*a* connected to elongated inclined members 13*b* and 13*c* that are attached to the opposite first and second ends of the generally horizontal member 13*a* to define a central triangular shaped opening. For example, a first inclined member 13*b* can have its first end connected to a first end of the generally horizontal member 13*a* and have it second end attached to the second end of the second elongated inclined member 13*c*. The first end of the second inclined member 13*c* can be attached to the second end of the generally horizontal member 13*a*. In some embodiments, the base member 13 may be integrally cast or molded to form the base member. In other embodiments, the base member may have the generally horizontal member fastened or otherwise attached to the elongated inclined members 13*b* and 13*c*.

At least one vertical post or other type of vertical member 11 of the base 3 can extend vertically from adjacent its first end that is connected to the upper second ends of the first and second inclined members 13*b* and 13*c* to its upper second end. The upper second end of the vertical member 11 can be connected to multiple inclined arms such as a first inclined arm 11*a* and a second inclined arm 11*b*. Each inclined arm can extend upwardly and sidewardly away from the upper end of the vertical member 11. The inclined arms 11*a* and 11*b* can be configured for connection to the seat 7 so that that the base 3 can support the seat 7.

For instance, each of the upper inclined arms 11*a* and 11*b* may have its first end attached to the upper end of the vertical member 11 and have its second end positioned higher and outwardly relative to the upper end of the vertical member. The second end of the first inclined arm 11*a* may be positioned adjacent to and below a first side of the seat and the second end of the second inclined arm 11*b* may be positioned adjacent to and below a second side of the seat that is opposite the first side of the seat 7.

In some embodiments, the upper first and second inclined arms 11*a* and 11*b* may be integral with the vertical member 11 via casting or injection molding or may be otherwise attached to the vertical member 11. For instance, in some embodiments, the base 3 may be structured such that the base member 13, vertical member 11, and the first and second inclined arms 11*a* and 11*b* are a unitary structure that is cast or molded as an integral structure. As another example, the vertical member 11 may be attached to the base member 13 and may be integral with the first and second inclined arms 11*a* and 11*b* via casting, welding, or molding in other embodiments. In yet other embodiments, each arm may be fastened or otherwise attached to the vertical member 11.

The tilting mechanism of the chair can include at least one tilt mechanism component attached to the base 3 and at least one tilt mechanism component attached between the seat 7 and the base 3. For instance, the tilt mechanism can include at least one deformable element connected to the base 3. For example, as may be appreciated from FIG. 4, the floor engagement member 15 can be configured to cover a plurality of spaced apart deformable fingers 19 that extend forwardly and rearwardly from the generally horizontal member 13*a* of the base member 13. The fingers 19 can include a first set of fingers 19*a* and a second set of fingers 19*b*. Each set of fingers can include forwardly extending fingers 19*c* and rearwardly extending FIG. 19*d*. The rearwardly extending fingers may extend away from the generally horizontal member 13*a* rearwardly and the forwardly extending fingers may extend away from the generally horizontal member 13*a* forwardly (e.g. in a direction that is opposite the direction at which the rearwardly extending fingers extend). The fingers 19 may be positioned between a first side 20 and a second side 22 of the base 3 (e.g. left and right sides of the base or right and left sides of the base).

The first and second set of fingers 19*a* and 19*b* can be positioned so that each of the rearwardly extending fingers 19*d* in a set of fingers is spaced apart from an immediately adjacent other rearwardly extending finger in that set by a gap 19*f*. The frontwardly extending fingers 19*c* in each set fingers can also be spaced apart from immediately adjacent other frontwardly extending fingers of the set by a gap 19*f*. Each set of fingers may be separated from each other by a space 19*g*. For instance, the first set of fingers 19*a* (e.g. the frontwardly extending and rearwardly extending fingers of the first set of fingers 19*a*) can be attached to the generally horizontal member 13*a* of the base member 13 adjacent the first side 20 of the base 3 and the second set of fingers 19*b* (e.g. the frontwardly extending and rearwardly extending fingers of the second set of fingers 19*b*) can be attached to the generally horizontal member 13*a* adjacent to the second side 22 of the base member 13. The first and second sets of fingers 19*a* and 19*b* can be positioned so that the space 19*g* between the first and second sets of fingers 19*a* and 19*b* can be in the central portion or middle portion of the generally horizontal member 13*a*. No fingers 19 may be attached on the generally horizontal member 13*a* within the space 19*g*.

Each finger 19 can be composed of spring steel, an elastomeric material, or other type of deformable material. A proximate end of each finger may be attached to the generally horizontal member 13*a* and a distal end of each finger may be located forward or rearward of the seat 7 and/or positioned to be below the front side of the seat or rear side of the seat at a location below the seat. Each finger's distal end may be configured to engage the floor to provide support to the base and permit the base to be tilted about at least one axis defined by the one or more points at which the finger may deform as it engages a floor and deforms in response to a force provided by a seated user that is sitting on the seat 7 and/or is leaning on the seat 7.

For example, a user may sit on the seat 7 and have his or her legs extend to the floor from the front side of the seat 7. The user may manipulate his or her legs by bending the user's knees to rock or bounce the seat 7 back and forth forwardly and backwardly, rock back and forth from a less forwardly to a more forwardly position, or rock back and forth from a vertically straight position to a forwardly leaning position. In response to the force of the user provided via the user's bending knees to initiate a forward lean while sitting on the seat 7 or leaning on the seat 7, the forwardly extending fingers 19*c* may deform from a first state to a second deformed state in which the fingers are more curved and/or compressed when in the second state. At the same time, the forward leaning provided by the user may result in the rearward fingers 19*d* adjusting from a first compressed state to a second less compressed state in which the rearwardly extending fingers 19*d* are less deformed, less curved, or less flexed. In response to the user's knees straightening from a bent position, the forwardly leaning fingers 19*c* may become less deformed and adjust from their second deformed state back to their first deformed state while the rearwardly extending fingers may become more deformed (and more compressed) and compress from the second compressed state back to their first compressed state.

The spacing and arrangement of the fingers 19 can also be configured to contribute to providing increased support when a user may provide a side-to-side or lateral force, such as swiveling in the user's seat. The deformability of the fingers in addition to the spacing and extent to which the fingers 19 extend can also facilitate such support so that the base may support a wide range of user motion.

The floor engagement member 15 may be structured to entirely cover the fingers 19. The floor engagement member may be composed of an elastomeric material, a polymeric material, a composite material, or other type of material. The floor engagement member 15 may have a bottom that has an outer surface that is composed of a material and/or is structured via ribbing, spaced apart beads, recesses, grooves and/or other projections and recesses to induce friction when the member is flexed, deformed, or otherwise moved along a floor surface or placed into contact with the floor surface. The structure of the floor engagement member 15 can also be configured to facilitate such flexing or deformation. For instance, the floor engagement member 15 can be structured so that a bottom of the floor engagement member is concave in shape (e.g. is bowed in shape or has an inner, central region that is raised relative to an outer peripheral portion, etc.) such that a peripheral bottom edge of the floor engagement member is in contact with the floor and a central portion of the bottom of the floor engagement member 15 can be flexed so that at least some of this portion is in contact with the floor in response to at least one force that may be provided by a user who is sitting or leaning on the seat 7. In at least some embodiments, the deformation or flexing of the floor engagement member 15 may be configured to occur at the same time as the deformation or flexing of the fingers 19 that are entirely enclosed within an inner cavity of the floor engagement member 15 such that the fingers flex or deform in engagement with the floor and in response to at least one user provided force while the floor engagement member 15 is also deformed or flexed in response to that user provided force for contact with the floor.

The floor engagement member 15 can be configured to spread out the force provided by the fingers 19 over a larger area to provide increased stability. Further, the floor engagement member 15 can also provide deformation or flexure in response to user force that works in conjunction with the flexure of the fingers 19 to provide a degree of freedom of motion for a user sitting or leaning on the seat 7. The floor engagement member 15 can also be configured so that the floor engagement member 15, by directly contacting the floor while the enclosed fingers engage the floor via the floor engagement member 15 that encloses the fingers 19, provides a desired amount of induced friction upon motion along a floor via the flexing of that member. The friction inducing feature of the floor engagement member 15 can help improve the stability of the base 3 and help keep the seating device 1 upright throughout a relatively large range of motion that may be induced by one or more forces provided by a user sitting on the seat 7 or leaning on the seat 7 as compared to having the fingers 19 directly contact the floor.

In some embodiments, the floor engagement member 15 may be composed of rubber, synthetic rubber, or other type of elastomeric material and have a tread defined on at least the bottom surface of the floor engagement member 15. In some embodiments, the floor engagement member may be composed of a thermoplastic elastomer (TPE) such as a thermoplastic polyester elastomer, a thermoplastic copolyester elastomer (TPC-ET), a polyether-ester block copolymer, styrenic block copolymers (TPE-s), a polyolefin blend (TPE-o), elastomeric alloy (TPE-v or TPV), a thermoplastic polyurethane (TPU), a thermoplastic copolyester, or a thermoplastic polyamide or may be composed of another type of material such as synthetic rubber, natural rubber, a thermoset elastomeric material, a cast urethane material, a polyurethane elastomeric material, a thermoset polyurethane material, a thermoset urethane material, or other type of elastomeric material or a type of polymeric material.

The floor engagement member 15 can be positioned to enclose a substantial portion (e.g. over 70% of the length of the generally horizontal member 13*a*, over 80% of the length of the generally horizontal member, over 90% of the length of the generally horizontal member, etc.) of the generally horizontal member 13*a* to which the fingers 19 are attached. For instance, the floor engagement member 15 may cover a portion of the length of the generally horizontal member that extends from adjacent to where the generally horizontal member 13*a* is attached to the first inclined member 13*b* to a position adjacent to where the generally horizontal member 13*a* is attached to the second inclined member 13*c*.

In some embodiments, the floor engagement member 15 may be attached to the base member 13 by having the generally horizontal member 13*a* to which the fingers 19 are attached passed through the inner cavity of the floor engagement member 15 so that the floor engagement member 15 encloses a portion of the generally horizontal member 13*a* positioned in its inner cavity and all of the fingers 19. Thereafter, fasteners 16 may be passed through the bottom of the floor engagement member 15 and into the bottom of the generally horizontal member 13*a*. For instance, a fastener may be positioned adjacent the first side 20 of the base member 13 and a fastener 16 can be positioned adjacent the second side 22 of the base member for facilitating the attachment of the floor engagement member 15 to the generally horizontal member 13*a* of the base member 13. In addition, or as an alternative, welding, adhesive, or other fastening mechanisms may also be utilized to help affix the floor engagement member 15 to the generally horizontal member 13*a* of the base member 13. After the floor engagement member 15 is attached to the generally horizontal member 13*a* to enclose the fingers and a portion of the generally horizontal member, the generally horizontal member 13*a* may be attached to each of the first and second inclined members 13*b* and 13*c*. via at least one fastener, welding, interlocking profiles, and/or at least one other fastening mechanism.

In some embodiments, it is contemplated the seating device 1 may be configured so that there are no fingers 19 within the floor engagement member 15. For such an embodiment, the floor engagement member 15 may be configured to provide flexing, deformation, and resiliency for supporting a user leaning or sitting on the seat 7 as the user may provide a force for rocking, tilting, or otherwise moving the seat 7 while the user sits or leans on the seat 7 such that the seat 7 is rockable or otherwise tiltable about at least one axis via the flexing of the floor engagement member 15. Such an embodiment may utilize the floor engagement member 15 such that no fingers are included in the seating device 1. For such embodiments, the central portion of the floor engagement member 15 may have an inner channel that receives a substantial portion of the length of the generally horizontal member 13*a* of the base member 13 and may be fastened to that member. The floor engagement member 15 can be so attached such that the bottom of the floor engagement member 15 can have a concave shape 29 such that an outer peripheral portion 15*a* of the bottom is in contact with a floor and an inner central region 15*b* of the floor engagement member 15 is raised relative to the lower outer peripheral portion. The outer peripheral portion 15*a* can be configured so that front and rear sides 15*c* and 15*d* of the outer peripheral portion contact a floor while the left and right sides 15*e* and 15*f* of the floor engagement member 15 are structured to extend upwardly from the front and rear sides 15*c* to middle portion 15*g* of the left side and a middle portion 15*h* of the right side and do not contact the floor.

During flexing of the floor engagement member 15, the central portion and the outer peripheral portion may be flexed in response to at least one user provided force to permit tilting of the seat 7 about at least one axis. Due to such flexing, at least a portion of the inner central region may be flexed sufficiently to also contact the floor. Upper portions of the left and/or right sides 15*e* and 15*f* may also be moved due to such flexing into contact with the floor. The bottom portion of the floor engagement member 15 may include at least one tread or other type of profile (e.g. recesses, protuberances, bumps, grooves, a combination thereof, etc.) to help improve stability of the support provided by the base 3 and the floor engagement member 15 by helping to induce a relatively high amount of friction when moving along a floor (e.g. a flooring surface, etc.) when the floor engagement member 15 is flexed or deformed due to one or more forces provided by a user sitting or leaning on the seat 7.

The tilt mechanism of the seating device 1 can also include a component that is configured to connect the seat 7 to the base 3 to provide for tilting of the seat 7 about at least one axis of rotation that is defined by at least one member that may flex or be deformed in response to force provided by a user sitting or leaning on the seat 7. For example, at least one seat connecting member 9 can be connected between the seat 7 and the upper portion of the base 3. For example, a first deformable member 9*a* and a second deformable member 9*b* can be positioned to extend from underneath opposite sides of the seat 7 to the upper portion of the base 13. For instance, the first deformable member 9*a* may extend from adjacent a first side of the seat to an upper portion of the base and the second deformable member 9*b* may extend from a second side of the seat to an upper portion of the base. Each deformable member's lower end may be positioned below and inward relative to its upper end. Each deformable member may be composed of a polymeric material, a resilient material, a flexible or resilient metal such as spring steel, or an elastomeric material.

In some embodiments, the first and second deformable members 9*a* and 9*b* may be separate members that are each fastened to the seat 7. In other embodiments, the first and second deformable members 9*a* and 9*b* may be portions of a unitary structure. For instance, the first and second deformable members may be declinedly extending members that extend downwardly and inwardly from adjacent opposite sides of the seat 7 and may be opposite side portions of an annular triangularly shaped deformable seat connecting member 9 that connects the seat 7 to the first and second inclined arms 11*a* and 11*b* of the base 3. Such a seat connecting member 9 may be formed as an integral one piece body defining a central triangular shaped opening via casting or molding and may be composed of an elastomeric material such as, for example, a synthetic rubber, a natural rubber, a thermoplastic elastomer (TPE) such as a thermoplastic polyester elastomer, a thermoplastic copolyester elastomer (TPC-ET), a polyether-ester block copolymer, styrenic block copolymers (TPE-s), a polyolefin blend (TPE-o), elastomeric alloy (TPE-v or TPV), a thermoplastic polyurethane (TPU), a thermoplastic copolyester, or a thermoplastic polyamide or the seat connecting member 9 may be composed of a thermoset elastomeric material, a cast urethane material, a polyurethane elastomeric material, a thermoset polyurethane material, a thermoset urethane material, or another type of elastomeric material or a type of polymeric material. In yet other embodiments, it is contemplated that the seat connecting member 9 can be composed of a spring steel or other type of flexible, resilient material.

In some embodiments, each seat connecting member 9 may include an inner core element that is enclosed within a covering material that is over-molded to the inner core and/or otherwise attached to that inner core element. The core element may be composed of a different material than the covering or may be composed of the same material of the covering but have a different shape to facilitate a contribution to the overall resiliency, deformability and/or flexibility of the formed member that differs from the contribution the covering may make to such properties of the member. For instance, as can be seen from FIGS. 6-7, the seat connecting member 9 can be structured to include at least one inner element that is enclosed or entirely enclosed by an elastomeric or polymeric covering that may be over-molded or otherwise attached to each inner element. For instance, each seat connecting member 9 (e.g. a unitary seat connecting member 9 or separate deformable members 9*a* and 9*b* that may extend downwardly from the seat 7 to an upper portion of the base) may have an inner element that is composed of a metal, polymeric material, or elastomeric material that is covered by a covering. The inner element and covering may each contribute to the flexibility, deformability, and/or resiliency of the seat connecting member 9.

For example, the first deformable member 9*a* may include a covering that is over-molded to a first inner element 31 and the second deformable member 9*b* can include a covering that is over-molded to a second inner element 33*b*. A seat connecting inner element 35 can be positioned between the first and second inner elements 31*a* and 33*b* and be positioned for attachment to the bottom of the seat 7. In some embodiments, the seat connecting inner element 35 can be positioned to extend along a substantial portion of the length of the seat 7 along the underside of the seat 7 between the first and second inner elements 31*a* and 33*b* or can be configured to extend along the entire length of the seat 7 along the underside of the seat 7.

In some embodiments, the first and second deformable members 9*a* and 9*b* may not be connected to the seat connecting inner element 35 and may, instead have their upper ends fastened or otherwise attached to the bottom of the seat 7 to a respective side portion of the seat. In other embodiments, the first and second deformable members 9*a* and 9*b* may be part of a unitary seat connecting member 9 that is formed by having an integral inner element having first, second and third portions that are structured as first and second downwardly extending first and second inner elements 31*a* and 33*b* that extend downwardly form opposite sides of a central seat connecting inner element 35. The unitary inner element structure may be cast or molded as a one piece structure that is subsequently over-molded or otherwise attached to a one piece molded or one-piece casting covering the encloses the unitary inner element. In some embodiments, the covering may completely enclose that unitary inner element. In other embodiments, the covering may completely enclose the first and second inner elements 31*a* and 33*b* and may cover a bottom portion of the seat connecting inner element 35 that is positioned for attachment to the bottom of the seat 7.

The first and second deformable members 9*a* and 9*b* can be configured to flex and/or deform about at least one axis in response to a force provided by a user sitting or leaning on the seat. For instance, each deformable member may rotate about a first axis of rotation in response to a user leaning forwardly or rearwardly on the seat and may also twist or otherwise rotate about a second axis when deforming or flexing in response to such leaning. The deformability and/or flexing provided by each seat connecting member 9 can be configured so that the seat 7 is tiltable about multiple axes that are not pre-defined by a hard axle, but instead are moveably defined by the deformability or resilient of the member. This freedom of movement, in combination with the similar undefined axis of rotation tiltability provided by the fingers 19 and/or floor engagement member 15 can provide an improved freedom of movement for a user sitting or leaning on the seat 7.

Additional flexibility and further improved freedom of movement for a seated user can also be provided by a structure of the seat 7. For instance, the seat 7 can include a covering 7*a* that may be, for example, a polymeric seat structure such as a type of saddle seat or other type of seat structure or may be fabric covered upholstered body structure (e.g. a covered cushion, etc.), That covering element may be attached to a seat core member 7*b* or other portion of a seat frame 5, For instance, the covering 7*a* may be attached to a seat core member 7*b* that is configured so that the covering 7*a* rests on the core member 7*b* so that the core member 7*b* can contribute to the cushioning effect provided by the covering 7*a* of the seat 7. The core member 7*b* can also be configured to facilitate attachment of the seat 7 to each seat connecting member 9.

The core member 7*b* can be positioned under the covering 7*a* or may be positioned at least partially within the covering 7*a* (e.g. entirely within the covering 7*a* or partially within the covering 7*a* with a portion of the core element uncovered via an opening 41 defined in the bottom of the covering 7*a*. The core member 7*b* can be a unitary core member 37 that has holes 39 formed therein. The holes 39 can be shaped to help define how the core member may flex or deform in response to weight or other force a user may apply on the core member via leaning or sitting on the seat 7. A central portion of the core member 7*b* can be configured for attachment to the seat connecting inner element 35. The entire length of the central portion of the core member 7*b* can be defined to receiving the seat connecting inner element 35 and having one or more fasteners passed through the core member 7*b* for attachment of the seat connecting inner element 35 to the core member 7*b*. Adhesive, welding, or other type of fastening mechanism can also be used, or be used as an alternative to or in addition to fasteners for such attachment as well.

The core member 7*b* can be sized and shaped for being positioned within an inner cavity defined in the covering 7*a* for connection of the core member 7*b* to the covering 7*a* for forming the seat 7. For instance, the core member 7*b* may be passed through a bottom opening 41 for positioning within an inner cavity defined in the covering 7*a* for receiving the core member 7*b*. The covering 7*a* may be positioned on the core member via the bottom opening 41 after the core member 7*b* is attached to the seat connecting member 9 (e.g. fastened to the seat connecting inner element 35 and/or attached to an upper end portion of each of the first and second deformable members 9*a* and 9*b*).

The core member 7*b* can be configured to contribute to the flexibility and deformability of the seat 7. For instance, the covering 7*a* may be configured to provide a level of comfort to a user while the core member 7*b* may contribute to such comfort by providing flexure and deformation via the material property of the material of the core member and the holes 39 formed in the core member. The core member 7*b* may also permit the seat to tilt via deformation of portions of the core member 7*b* and/or twisting or other type of tilting of the core member 7*b* about its connection to at least one seat connecting member 9. The flexure and/or resiliency provided by the core member 7*b* can further contribute to the freedom of motion that may be provided to a user by the seating device 1 and the tilt mechanism of the seating device.

It should be understood that embodiments of the seating device may be configured to meet different design criteria. For instance, the seating device 1 can be configured as a sit/stand stool, a chair, or other type of seating device. As another example, the shape and size of the seating surface, the structure of the seat frame 5, and/or the size and shape of the base 3 may be adjusted to meet a particular set of design criteria. As yet another example, the generally horizontal member 13*a* of the base member 13 may be structured to be bowed or curved so that the member extends horizontally and also extends vertically via an angle of curvature or along a curve of that member or may be a linearly extending member that extends horizontally. As yet another example, the vertical member 11 can be configured to include a height adjustment mechanism for providing height adjustment of the seat 7 via a gas spring or other type of height adjustment mechanism. As yet another example, the seat connecting member 9 can be configured to not include any inner elements but merely be a unitary structure composed of an elastomeric material throughout the entirety of the member without having any inner seat connecting element 35 or first and second inner elements 31*a* and 33*b* covered by any covering member or other type of covering element. In yet other embodiments, it is contemplated that an embodiment of the seating device 1 may not include a floor engagement member 15, but can instead be configured to have the fingers 19 directly contact a floor for engagement with the floor instead of engaging the floor via the floor engagement member 15. Therefore, while certain exemplary embodiments of seating devices and height adjustment mechanisms for seating devices and methods of making and using the same have been discussed and illustrated herein, it is to be distinctly understood that the invention is not limited thereto but may be otherwise variously embodied and practiced within the scope of the following claims.

What is claimed is:

1. A seating device comprising:

a seat;

a base connected to the seat to support the seat;

a tilt mechanism connected to at least one of the base and the seat, the tilt mechanism comprising:

an elastomeric floor engagement member that is attached to the base such that an outer peripheral portion of a bottom of the floor engagement member contacts the floor, the floor engagement member being configured to flex in response to a force provided by a user sitting or leaning on the seat;

the bottom of the floor engagement member being concave in shape such that the outer peripheral portion of the bottom contacts the floor and flexure or deformation of the floor engagement member results in a portion of the bottom inside of the outer peripheral portion of the bottom being moved into contact with the floor; and wherein the floor engagement member is comprised of an elastomeric material.

2. The seating device of claim 1, wherein the tilt mechanism also comprises at least one seat connecting member connecting the seat to an upper portion of the base, the at least one seat connecting member having a first deformable member and a second deformable member;

the first deformable member extending from a first side of the seat to the upper portion of the base;

the second deformable member extending from a second side of the seat to the upper portion of the base, the second side of the seat being opposite the first side of the seat.

3. A seating device comprising:

a seat;

a base connected to the seat to support the seat;

a tilt mechanism connected to at least one of the base and the seat, the tilt mechanism comprising:

at least one seat connecting member connecting the seat to an upper portion of the base, the at least one seat connecting member having a first deformable member and a second deformable member;

the first deformable member extending from a first side of the seat to the upper portion of the base;

the second deformable member extending from a second side of the seat to the upper portion of the base, the second side of the seat being opposite the first side of the seat;

wherein the base is comprised of:

a vertically elongated member that is connected to lower ends of the first and second deformable members;

first and second inclined members that are connected to a bottom end of the vertically elongated member; and a generally horizontal member having a first end connected to a lower end of the first inclined member and a second end connected to a lower end of the second inclined member.

4. The seating device of claim 3, wherein the tilt mechanism is also comprised of a plurality of resilient fingers that are attached to the base to engage a floor, the fingers being configured to flex in response to a force provided by a user sitting or leaning on the seat, the fingers being attached to the generally horizontal member for being attached to the base.

5. The seating device of claim 4, wherein the tilt mechanism is also comprised of an elastomeric floor engagement member that is attached to the base such that an outer peripheral portion of a bottom of the floor engagement member contacts the floor, the floor engagement member being configured to flex in response to a force provided by a user sitting or leaning on the seat, the floor engagement member being connected to the generally horizontal member such that the floor engagement member encloses the fingers.

6. The seating device of claim 5, wherein the floor engagement member entirely encloses all of the fingers and also encloses a portion of the generally horizontal member.

7. The seating device of claim 6, wherein the first and second deformable members are portions of a unitary seat connecting member structure that is formed as a one piece structure that is generally triangular in shape; and wherein the base also comprises a first inclined arm that extends outwardly away from an upper end of the vertically elongated member adjacent to a first side of the seat and a second inclined arm that extends outwardly away from the upper end of the vertically elongated member adjacent to a second side of the seat, the first inclined arm attached to the first deformable member and the second inclined arm attached to the second deformable member; and wherein the first and second inclined members and the generally horizontal member are connected together to define a generally triangular shaped base member.

8. The seating device of claim 6, wherein the seat is comprised of a core member and a covering attached to the core member, the core member being attached to the first and second deformable member.

9. The seating device of claim 8, wherein the core member is within the covering.

10. The seating device of claim 9, wherein:

the covering has an opening defined in a bottom of the covering, and the core member is attached to the first and second deformable members via an inner seat connecting element that extends between the first and second deformable members, the inner seat connecting element connected to the core member in the opening of the covering.

11. The seating device of claim 10, wherein the core member has a plurality of holes.

12. The seating device of claim 10, wherein the first deformable member has a first inner element within a covering of that member and the second deformable member has a second inner element within a covering, the inner seat connecting element extending between the first and second inner elements and being integrally connected to the first inner element and the second inner element.

13. The seating device of claim 12, wherein the first and second deformable members are portions of a unitary seat connecting member structure that has a generally triangular shape.

14. The seating device of claim 13, wherein the first and second inclined members are attached to the generally horizontal member to define a generally triangular shaped base member.

15. A seating device comprising:

a seat:

a base connected to the seat to support the seat;

a tilt mechanism connected to at least one of the base and the seat, the tilt mechanism comprising:

(i) a plurality of resilient fingers that are attached to the base to engage a floor, the fingers being configured to flex in response to a force provided by a user sitting or leaning on the seat, and (ii) an elastomeric floor engagement member that is attached to the base such that an outer peripheral portion of a bottom of the floor engagement member contacts the floor, the floor engagement member being configured to flex in response to a force provided by a user sitting or leaning on the seat; and the base is comprised of:

a vertically elongated member;

first and second inclined members that are connected to a bottom end of the vertically elongated member; and a generally horizontal member having a first end connected to a lower end of the first inclined member and a second end connected to a lower end of the second inclined member, the fingers being attached to the generally horizontal member for being attached to the base; and the floor engagement member being connected to the generally horizontal member such that the floor engagement member encloses the fingers.

16. The seating device of claim 15, wherein the first and second inclined members and the generally horizontal member are connected together to define a generally triangular shaped base member.

17. The seating device of claim 15, wherein each of the fingers extend away from the generally horizontal member and are configured to at least one of flex and deform in response to at least one force provided by a user sitting or leaning on the seat, and wherein the floor engagement member is configured to at least one of flex and deform in response to the at least one force provided by the user; and wherein the bottom of the floor engagement member is concave in shape such that the outer peripheral portion of the bottom contacts the floor and flexure or deformation of the floor engagement member results in a central portion of the bottom inside of the outer peripheral portion of the bottom contacting the floor.

18. The seating device of claim 17, wherein the floor engagement member is configured to flex in response to the at least one force provided by the user at a same time that the fingers flex.

19. The seating device of claim 17, wherein the bottom of the floor engagement member has a profile or at least one tread defined thereon.

* * * * *